United States Patent [19]

Goudriaan et al.

[11] 4,120,778

[45] Oct. 17, 1978

[54] PROCESS FOR THE CONVERSION OF HYDROCARBONS IN ATMOSPHERIC CRUDE RESIDUE

[75] Inventors: Frans Goudriaan; Jakob Van Klinken, both of Amsterdam, Netherlands

[73] Assignee: Shell Oil Company, Houston, Tex.

[21] Appl. No.: 831,850

[22] Filed: Sep. 9, 1977

[30] Foreign Application Priority Data

Sep. 22, 1976 [NL] Netherlands ..... 7610510

[51] Int. Cl.[2] ..... C10G 39/00; C10G 13/06

[52] U.S. Cl. ..... 208/80; 208/59; 208/86; 208/108; 208/210; 208/218; 208/251 H

[58] Field of Search ..... 208/80, 86, 59, 58, 208/78, 210, 218, 251 H

[56] References Cited

U.S. PATENT DOCUMENTS

| | | | |
|---|---|---|---|
| 2,801,208 | 7/1957 | Horne et al. | 208/61 |
| 2,914,470 | 11/1959 | Johnson et al. | 208/264 |
| 3,175,966 | 3/1965 | Burch | 208/79 |
| 3,380,910 | 4/1968 | Griffiths | 208/58 |
| 3,394,077 | 7/1968 | Kovach et al. | 208/216 |
| 4,062,758 | 12/1977 | Goudriaan et al. | 208/80 |

*Primary Examiner*—Delbert E. Gantz
*Assistant Examiner*—G. E. Schmitkons
*Attorney, Agent, or Firm*—Ronald R. Reper

[57] ABSTRACT

A process is disclosed for the conversion of a hydrocarbon oil vacuum distillation residue to one or more atmospheric distillates by a processing sequence comprising vacuum fractionation, catalytic cracking or hydrocracking, atmospheric fractionation, hydrotreating, atmospheric fractionation, and vacuum fractionation with certain recycle of intermediate streams to achieve efficient, economic operation.

8 Claims, 2 Drawing Figures

PROCESS FOR THE CONVERSION OF HYDROCARBONS IN ATMOSPHERIC CRUDE RESIDUE

BACKGROUND OF THE INVENTION

The invention relates to a process for the preparation of one or more atmospheric hydrocarbon oil distillates from a hydrocarbon oil residue obtained by vacuum distillation.

In the atmospheric distillation of crude mineral oil, as applied on a large scale in refineries for the preparation of atmospheric distillates, a residual oil is obtained as a by-product. To increase the yield of atmospheric distillates from a crude oil, a vacuum distillate can be separated from the said residual oil by vacuum distillation, which vacuum distillate can be converted, for instance by catalytic cracking or hydrocracking, into one or more atmospheric distillates. Just as in atmospheric distillation, a residual oil is obtained as a by-product in vacuum distillation. In some cases this residual oil is suitable for use as the starting material for the preparation of residual lubricating oil, but generally the residual oil, which as a rule contains considerable quantities of sulphur, metals and asphaltenes, is only suitable for use as a fuel oil component.

In view of the increasing demand for atmospheric distillates, attempts were made in the past to convert the vacuum residues into atmospheric distillates, for instance by catalytic cracking or hydrocracking. The use of the vacuum residues as such as the feed for these processes has serious drawbacks which preclude their application on a commercial scale. Thus, major drawbacks of, for instance, catalytic cracking of the vacuum residues are that it entails very high catalyst consumption and that because of the very high coke and gas production only a low yield of the desired atmospheric distillates is obtained. Hydrocracking of the vacuum residues involves a rapid catalyst deactivation, a high gas production and a high hydrogen consumption.

In view of the above and considering the fact that in the processing of crude mineral oil into atmospheric distillates via atmospheric distillation and vacuum distillation combined with conversion of the vacuum distillate, considerable quantities of vacuum residue are obtained as by-product, it will be clear that there is an urgent need for a process which offers the possibility of converting these vacuum residues in an economically justifiable way into distillates such as gasolines.

Since catalytic cracking and hydrocracking have proved in practice to be excellent processes for the conversion of vacuum distillates such as vacuum gas oils into atmospheric distillates such as gasolines, the applicants have carried out an investigation to find out to what extent these processes can be employed in the conversion of the above-mentioned vacuum residues. A highly suitable process has now been found employing certain combination of catalytic cracking or hydrocracking as the main operation and a catalytic hydrotreatment as a supplementary operation.

SUMMARY OF THE INVENTION

According to the invention there is provided a process for the preparation of atmospheric hydrocarbon oil distillates from a hydrocarbon oil residue obtained by atmospheric distillation which comprises:

(a) fractionating said residue by vacuum distillation into a vacuum distillate, and a vacuum residue, which is passed to step (d), (b) cracking said vacuum distillate in a cracking zone comprising either a catalytic cracking zone or a hydrocracking zone to obtain a cracked product, (c) fractionating said cracked product by atmospheric fractionation distillation into at least one light distillate product, a cracked intermediate fraction and a cracked residue, and recycling at least part of said cracked intermediate fraction or said cracked residue to the cracking zone of step (b), (d) hydrotreating the vacuum residue from step (a) in a catalytic hydrotreating zone under such conditions that more than 50% by weight of the total feed to the catalytic hydrotreating zone is converted to a product having a lower boiling point than the feed, (e) fractionating said hydrotreated product by atmospheric fractionation distillation into at least one light atmospheric distillate product, a hydrotreated intermediate fraction and a hydrotreated residue, (f) fractionating said hydrotreated residue by vacuum distillation into a vacuum distillate and a hydrotreated vacuum residue, and then, (g) recycling at least 50% by weight of the hydrotreated vacuum residue from step (f) to the cracking zone of step (b).

DESCRIPTION OF PREFERRED EMBODIMENTS

Figure 1:
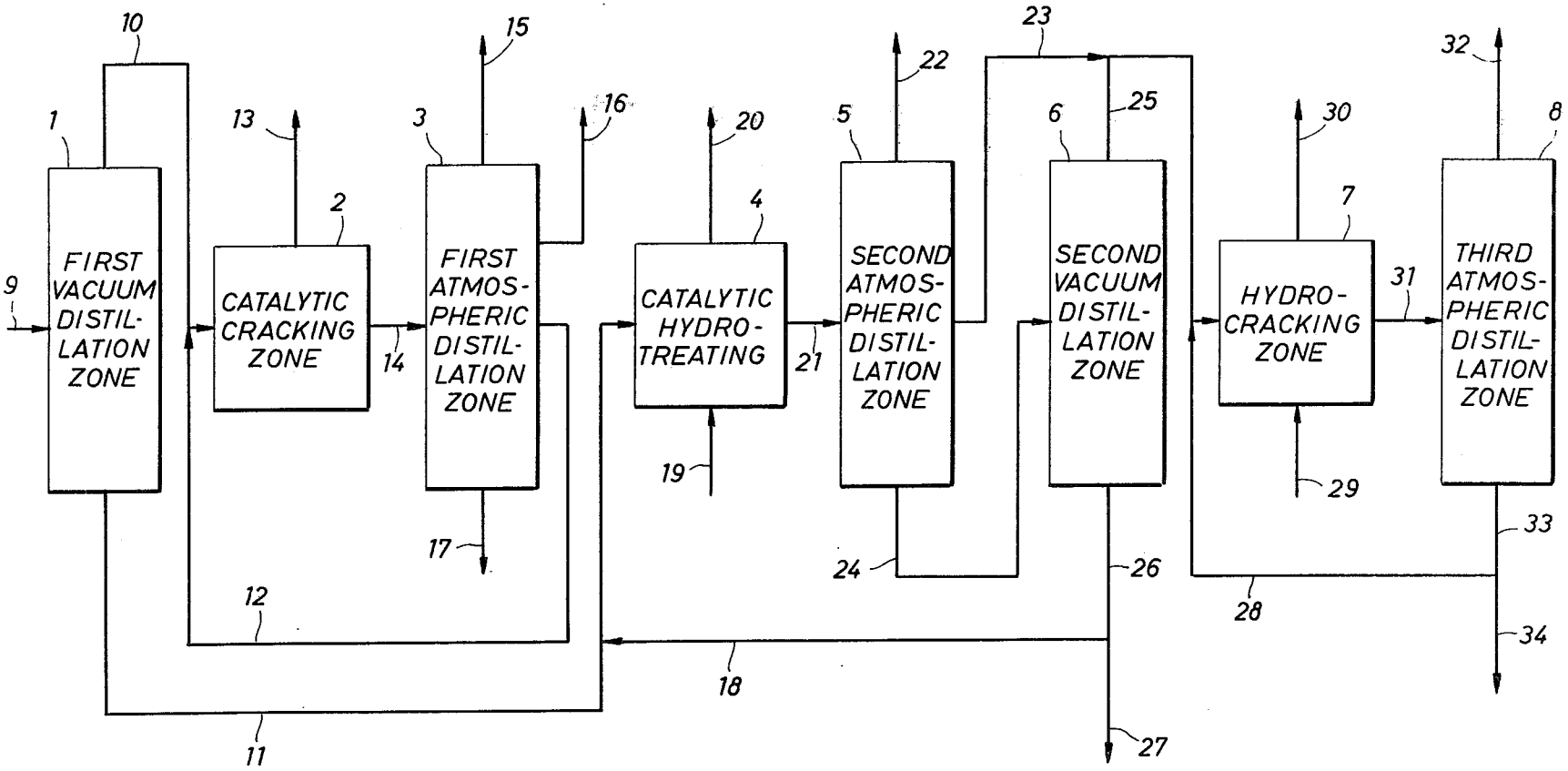
FIGS. 1 and 2 each schematically illustrate different embodiments of the processing scheme according to the invention.
Figure 2:
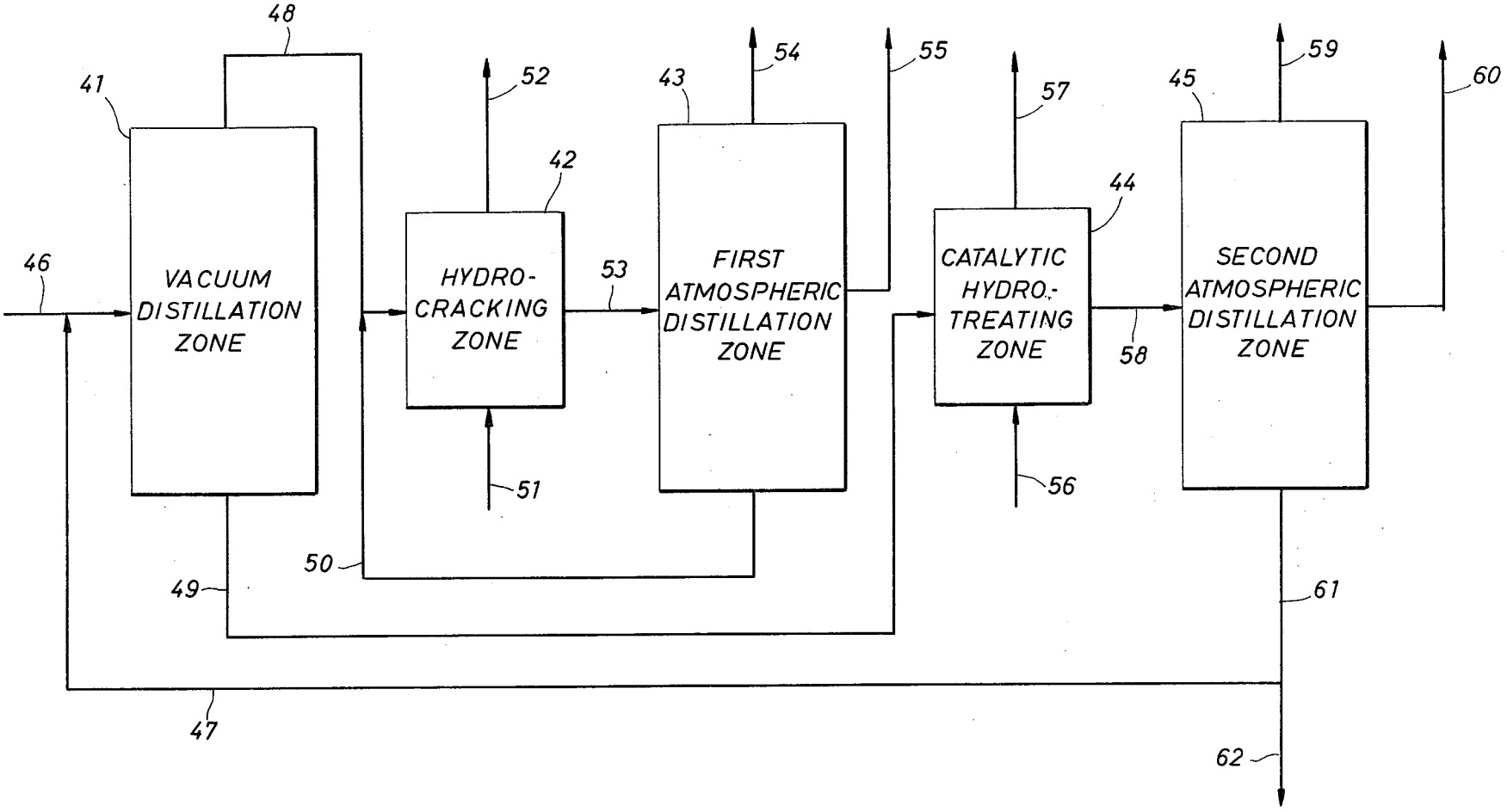

The process according to the invention comprises catalytic cracking or hydrocracking of a vacuum distillate as the main operation. In this operation a considerable proportion of the vacuum distillate is converted into the desired atmospheric distillates. One or more atmospheric distillates are separated as end products from the cracked product by distillation. To increase the yield of atmospheric distillates it is preferred to recycle at least part of the atmospheric residue obtained in the distillation of the cracked product to the catalytic cracker or hydrocracker. If the process according to the invention comprises catalytic cracking as the main operation and, in addition, at least part of the aforementioned atmospheric residue is recycled to the catalytic cracking unit, this liquid is preferably given a light catalytic hydrotreatment before it is subjected to catalytic cracking again. In the catalytic cracking process, which is preferably carried out in the presence of a zeolitic catalyst, coke is deposited on the catalyst. This coke is removed from the catalyst by burning-off during a catalyst regeneration step that is combined with the catalytic cracking, whereby a waste gas is obtained which contains carbon monoxide and carbon dioxide. Catalytic cracking is preferably carried out at an average temperature in the range from about 400° to about 550° C. and particularly from about 450° to 525° C., a pressure in the range from about 1 to 10 bar and particularly from about 1.5 to 7.5 bar, a space velocity in the range from about 0.25 to 4 $kg.kg^{-1}.h^{-1}$ and particularly from about 0.5 to 2.5 $kg.kg^{-1}.h^{-1}$ and a rate of catalyst replenishment in the range from about 0.1 to 5 and particularly from about 0.2 to 2 tonnes of catalyst per 1000 tonnes of feed.

Instead of catalytic cracking it is also possible to use hydrocracking as the main operation in the process according to the invention. Hydrocracking is effected by contacting the feed at elevated temperature and pressure and in the presence of hydrogen with a suitable hydrocracking catalyst. Hydrocracking is preferably carried out as a two-stage process, in which the hydrocracking proper, which is effected in the second stage, is preceded by a catalytic hydrotreatment in the first stage which serves mainly to reduce the nitrogen and polyaromatics contents of the feed to be hydrocracked. Catalysts suitable for use in the single stage hydrocracking process as well as in the second stage of the two-stage hydrocracking process are moderately and strongly acidic catalysts comprising one or more metals having hydrogenation activity on a carrier. Catalysts suitable for use in the first stage of the two-stage hydrocracking process are weakly and moderately acidic catalysts comprising one or more metals having hydrogenation activity on a carrier. Hydrocracking is preferably carried out at an average temperature in the range from about 250° to 450° C. and particularly from about 300° to 425° C., a hydrogen partial pressure in the range from about 25 to 300 bar and particularly from about 50 to 150 bar, a space velocity in the range from about 0.1 to 10 $kg.l^{-1}.h^{-1}$ and particularly from 0.25 to 2 $kg.l^{-1}.h^{-1}$ and a hydrogen-to-feed ratio in the range from about 200 to 3000 $Nl.kg^{-1}$ and particularly in the range from about 500 to 2000 $Nl.kg^{-1}$. If the hydrocracking is carried out according to the two-stage process it is preferred to use the whole reaction product from the first stage (without separation of ammonia, hydrogen sulphide, or other volatile components) as the feed for the second stage.

The process according to the invention also comprises a supplementary operation in which a catalytic hydrotreatment is applied to a vacuum residue. This catalytic hydrotreatment has to be carried out under such conditions that more than 50%w of the feed for the catalytic hydrotreatment is converted into products having a lower boiling point. This catalytic hydrotreatment is preferably conducted as a two-stage process, in which the conversion proper into products having a lower boiling point, which conversion is effected in the second stage, is preceded by a catalytic hydrotreatment which serves mainly to reduce the metal content of the feed to be converted. Catalysts suitable for use in the one-stage catalytic hydrotreatment as well as in the second stage of the two-stage catalytic hydrotreatment comprise one or more metals having hydrogenation activity on a carrier, which carrier consists of more than 40%w alumina. Catalysts suitable for use in the first stage of the two-stage catalytic hydrotreatment consist of more than 80%w silica. The catalytic hydrotreatment is preferably carried out at an average temperature in the range from about 375° to 475° C. and particularly from about 390° to 450° C., a hydrogen partial pressure in the range from about 25 to 300 bar and particularly from about 50 to 200 bar, a space velocity in the range from about 0.1 to 1.5 $kg.l^{-1}.h^{-1}$ and particularly from about 0.2 to 1.0 $kg.l^{-1}.h^{-1}$ and a hydrogen-to-feed ratio in the range from about 250 to 2500 $Nl.kg^{-1}$ and particularly from about 500 to 2000 $Nl.kg^{-1}$. If the catalytic hydrotreatment is carried out in two stages, the first stage is preferably effected in the presence of a quantity of $H_2S$ corresponding to an $H_2S$ content of the gas at the reactor inlet of more than 10%v and the second stage in the presence of a quantity of $H_2S$ corresponding to an $H_2S$ content of the gas at the reactor inlet of less than 5%v.

As previously stated, the catalytic hydrotreatment according to the invention has to be carried out under such conditions that more than 50%w of the feed for the catalytic hydrotreatment is converted into products having a lower boiling point. Among these products are atmospheric distillates suitable as end products.

The process according to the invention is very suitable for use as part of a more extensive process for the preparation of atmospheric hydrocarbon oil distillates from atmospheric hydrocarbon oil residues. Such processes may be carried out as follows. An atmospheric hydrocarbon oil residue is separated by vacuum distillation into a vacuum distillate and a vacuum residue. The desired atmospheric hydrocarbon oil distillates are prepared from the vacuum distillate by catalytic cracking or hydrocracking and from the vacuum residue according to the invention. In the preparation of atmospheric distillates from atmospheric residues, both the conversion of the vacuum distillate from the atmospheric residue used as the starting material and the conversion of the vacuum distillate from the hydrotreated product may be effected by catalytic cracking or by hydrocracking. The conversion of the two vacuum distillates is preferably effected by the same treatment and in one unit. If the preparation of atmospheric distillates from atmospheric residues comprises catalytic cracking of the vacuum distillate from the atmospheric residue used as the starting material, this vacuum distillate is preferably subjected first to a light catalytic hydrotreatment. Just as the light catalytic hydrotreatment mentioned hereinbefore, which is preferably applied to the part of the catalytically cracked product to be recycled, if necessary, to the catalytic cracking unit, this treatment is primarily meant to reduce the metal content of the feed and thereby restrict the catalyst consumption in the cracking unit, and is further aimed at saturating the feed for the catalytic cracking unit with hydrogen and thereby decreasing carbon deposition on the cracking catalyst and raising the yield of the desired product. Both the light catalytic hydrotreatment of the residue to be recycled to the catalytic cracking unit and the light atmospheric residue used as the starting material are preferably carried out in the same unit.

In the process according to the invention at least 50%w of the vacuum residue of the hydrotreated product has to be subjected again to the catalytic hydrotreatment. If it is desired in the preparation of atmospheric distillates from atmospheric residues to use the same operation both for the conversion of the vacuum distillate from the atmospheric residue used as the starting material and for the conversion of the vacuum distillate from the hydrotreated product, i.e. either catalytic cracking or hydrocracking, then the process according to the invention can be effected with only one vacuum distillation section, by using the vacuum distillation section in which the atmospheric residue that is used as the starting material is separated into a vacuum distillate and a vacuum residue also for separating an atmospheric residue of the hydrotreated product.

The process according to the invention is suitable both for the preparation of exclusively one or more light distillates as the end products and for the preparation of one or more light distillates together with one or more middle distillates as the end products. If the aim is to prepare exclusively one or more light distillates as the end products, a middle distillate to be separated from the cracked product and having an initial boiling point above the final boiling point of the heaviest light distillate desired is also eligible for repeated cracking. In that case, besides the vacuum distillate of the hydrotreated product, a middle distillate to be separated from the hydrotreated product and having an initial boiling point above the final boiling point of the heaviest light distillate desired is also eligible for use as feed component for the catalytic cracking or hydrocracking to be carried out as the main operation.

Two process schemes for the conversion of atmospheric hydrocarbon oil residues into light and medium hydrocarbon oil distillates will be elucidated hereinafter in more detail by reference to the following drawings.

PROCESS SCHEME I (FIG. 1)

The process is carried out in an apparatus comprising successively the first vacuum distillation section 1, a catalytic cracking section 2, the first atmospheric distillation zone 3, a catalytic hydrotreating zone 4, the second atmospheric distillation zone 5, the second vacuum distillation zone 6, a hydrocracking zone 7 and the third atmospheric distillation zone 8. A hydrocarbon oil residue 9 obtained by atmospheric distillation is separated by vacuum distillation into a vacuum distillate 10 and a vacuum residue 11. The vacuum distillate 10 is mixed with a middle distillate fraction 12 and the mixture is catalytically cracked. The regeneration of the catalyst in the catalytic cracking unit produces a waste gas 13 containing carbon monoxide and carbon dioxide. The catalytically cracked product 14 is separated by atmospheric distillation into a butanes and lighter ($C_4$-) fraction 15, a gasoline fraction 16, a middle distillate fraction 12 and a residue 17 being a mixture of heavy cycle oil and slurry oil. The vacuum residue 11 is mixed with a vacuum residue 18 and the mixture, together with a hydrogen stream 19, is subjected to a catalytic hydrotreatment. After separation of a gas stream 20, substantially consisting of $C_4$- hydrocarbons and $H_2S$, from the hydrotreated product, the liquid reaction product 21 is separated by atmospheric distillation into a gasoline fraction 22, a middle distillate fraction 23 and a residue 24. The residue 24 is separated by vacuum distillation into a vacuum distillate 25 and a vacuum residue 26. The vacuum residue 26 is separated into two portions 18 and 27 having the same composition. The vacuum distillate 25 is mixed with the middle distillate fraction 23 and with an atmospheric residue 28, and the mixture, together with a hydrogen stream 29, is hydrocracked. After separation of a gas stream 30, substantially consisting of $C_4$- hydrocarbons, from the cracked product, the liquid reaction product 31 is separated by atmospheric distillation into a gasoline fraction 32 and a residue 33. The residue 33 is separated into two portions 28 and 34 having the same composition.

PROCESS SCHEME II (FIG. 2)

The process is carried out in an apparatus comprising successively a vacuum distillation zone 41, a hydrocracking zone 42, the first atmospheric distillation zone 43, a catalytic hydrotreating zone 44 and the second atmospheric distillation zone 45. A hydrocarbon oil residue 46 obtained by atmospheric distillation is mixed with an atmospheric residue 47 and the mixture is separated by vacuum distillation into a vacuum distillate 48 and a vacuum residue 49. The vacuum distillate is mixed with an atmospheric residue 50 and the mixture, together with a hydrogen stream 51, is hydrocracked. After separation of a gas stream 52, substantially consisting of $C_4$- hydrocarbons and $H_2S$, from the cracked product, the liquid reaction product 53 is separated by atmospheric distillation into a gasoline fraction 54, a middle distillation fraction 55 and a residue 50. The vacuum residue 49, together with a hydrogen stream 56, is subjected to a catalytic hydrotreatment. After separation of a gas stream 57, substantially consisting of $C_4$- hydrocarbons and $H_2S$, from the hydrotreated product, the liquid reaction product 58 is separated by atmospheric distillation into a gasoline fraction 59, a middle distillate fraction 60 and a residue 61. The residue 61 is separated into two portions 47 and 62 having the same composition.

The invention will now be elucidated by reference to the following examples.

The process according to the invention was applied to an atmospheric distillation residue of a crude oil from the Middle East. The atmospheric distillation residue had an initial boiling point of 370° C. By vacuum distillation of 100 pbw of the atmospheric residue, 44 pbw of a 520° C.$^+$ vacuum residue could be separated from it. The process was carried out according to process schemes I and II. The following conditions were applied in the various sections.

In both process schemes hydrocracking was carried out in two stages, and the whole reaction product from the first stage was used as the feed for the second stage; part of the cracked product was recycled to the first stage. In both schemes a sulphidic $Ni/Mo/F/Al_2O_3$ catalyst comprising 5 pbw nickel, 20 pbw molybdenum and 15 pbw fluorine per 100 pbw alumina was used for the first stage of hydrocracking and a sulphidic Ni/W/F/faujasite catalyst comprising 3 pbw nickel, 10 pbw tungsten and 5 pbw fluorine per 100 pbw faujasite for the second stage. Both stages of the hydrocracking were carried out under the conditions given in Table A.

Table A

| | I | | II | |
|---|---|---|---|---|
| Scheme No. | 1st stage | 2nd stage | 1st stage | 2nd stage |
| Average temp., ° C | 375 | 365 | 390 | 375 |
| $P_{H_2}$, bar | 120 | 115 | 120 | 115 |
| Space velocity, $kg.l^{-1}.h^{-1}$ | 1.0 | 1.0 | 0.9 | 0.9 |
| $H_2$/feed ratio, $Nl.kg^{-1}$ | 1000 | 1500 | 1000 | 1500 |

In process scheme I the catalytic cracking was carried out in the presence of a zeolitic cracking catalyst at a temperature of 490° C., a pressure of 2.2 bar, a space velocity of 2 $kg.kg^{-1}.h^{-1}$ and a rate of catalyst replenishment of 0.75 tonne of catalyst per 1000 tonnes of oil.

In both process schemes the catalytic hydrotreatment was conducted in two stages in the presence of an $Ni/V/SiO_2$ catalyst comprising 0.5 pbw nickel and 2 pbw vanadium per 100 pbw silica in the first stage and an $Ni/Mo/Al_2O_3$ catalyst comprising 4 pbw nickel and 11 pbw molybdenum per 100 pbw alumina in the second stage. Both stages of the catalytic hydrotreatment were carried out under the conditions given in Table B.

Table B

| | I | | II | |
|---|---|---|---|---|
| Scheme No. | 1st stage | 2nd stage | 1st stage | 2nd stage |
| Average temp., ° C | 425 | 435 | 425 | 428 |
| $P_{H_2}$, bar | 150 | 150 | 150 | 150 |
| Space velocity, $kg.l^{-1}.h^{-1}$ | 0.46 | 0.38 | 0.39 | 0.27 |
| $H_2$/feed ratio, | | | | |

Table B-continued

| Scheme No. | I 1st stage | I 2nd stage | II 1st stage | II 2nd stage |
|---|---|---|---|---|
| $Nl.kg^{-1}$ | 1000 | 1500 | 1000 | 1500 |

EXAMPLE I

This example was carried out according to process scheme I. With 100 pbw of the 370° C.+ atmospheric distillation residue 9 as the starting material, the following quantities of the various streams were obtained:
56.0 pbw 370°-520° C. vacuum distillate 10,
44.0 pbw 520° C.+ vacuum residue 11,
13.2 pbw $C_4$- fraction 15,
31.6 pbw $C_5$-200° C. gasoline fraction 16,
10.1 pbw 200°-370° C. middle distillate fraction 12,
7.3 pbw 370° C.+ residue 17,
1.6 pbw hydrogen 19,
7.2 pbw $C_4$- fraction + $H_2S$ 20,
61.9 pbw liquid product 21,
6.7 pbw $C_5$-200° C. gasoline fraction 22,
15.6 pbw 200°-370° C. middle distillate fraction 23,
39.6 pbw 370° C.+ residue 24,
13.5 pbw 370°-520° C. vacuum distillate 25,
26.1 pbw 520° C.+ vacuum residue 26,
23.5 pbw portion 18,
2.6 pbw portion 27,
1.0 pbw hydrogen 29,
2.1 pbw $C_4$- fraction 30,
27.8 pbw $C_5$-200° C.+ residue 32,
7.2 pbw 200° C.+ residue 33,
7.0 pbw portion 28, and
0.2 pbw portion 34.

EXAMPLE II

This example was conducted according to process scheme II. With 100 pbw of the 370° C.+ atmospheric distillation residue 6 as the starting material, the following quantities of the various streams were obtained:
68.6 pbw 370°-520° C. vacuum distillate 48,
57.0 pbw 520° C.+ vacuum residue 49,
2.4 pbw hydrogen 51,
6.4 pbw $C_4$- fraction + $H_2S$ 52,
41.3 pbw $C_5$-200° C. gasoline fraction 54,
23.3 pbw 200°-370° C. middle distillate fraction 55,
21.2 pbw 370° C.+ residue 60,
1.4 pbw hydrogen 56,
6.7 pbw $C_4$- fraction + $H_2S$ 57,
51.7 pbw liquid product 58,
6.6 pbw $C_5$-200° C. gasoline fraction 59,
18.3 pbw 200°-370° C. middle distillate fraction 60,
26.8 pbw 370° C.+ residue 61,
25.6 pbw portion 57, and
1.2 pbw portion 62.

What is claimed is:

1. A process for the preparation of atmospheric hydrocarbon oil distillates from a hydrocarbon oil residue obtained by atmospheric distillation which comprises:

(a) fractionating said residue by vacuum distillation into a vacuum distillate and a vacuum residue, (b) cracking said vacuum distillate in a cracking zone comprising either a catalytic cracking zone or a hydrocracking zone to obtain a cracked product, (c) fractionating said cracked product by atmospheric fractionation distillation into at least one light distillate product, a cracked intermediate fraction and a cracked residue, and recycling at least part of said cracked intermediate fraction or said cracked residue to the cracking zone of step (b), (d) hydrotreating the vacuum residue from step (a) in a catalytic hydrotreating zone under such conditions that more than 50% by weight of the total feed to the catalytic hydrotreating zone is converted to a product having a lower boiling point than the feed, (e) fractionating said hydrotreated product by atmospheric fractionation distillation into at least one light atmospheric distillate product, a hydrotreated intermediate fraction and a hydrotreated residue, (f) fractionating said hydrotreated residue by vacuum distillation into a vacuum distillate and a hydrotreated vacuum residue, and then, (g) recycling at least 50% by weight of the hydrotreated vacuum residue from step (f) to the cracking zone of step (b).

2. A process according to claim 1, wherein in step (d) the catalytic hydrotreatment is carried out as a two-stage process and that the first stage is effected in the presence of a quantity of $H_2S$ corresponding to an $H_2S$ content of the gas at the reactor inlet of more than 10%v and the second stage in the presence of a quantity of $H_2S$ corresponding to an $H_2S$ content of the gas at the reactor inlet of less than 5%v.

3. A process according to claim 1, wherein in step (b) catalytic cracking is carried out at an average temperature of from 400° to 550° C., a pressure of from 1 to 10 bar, a space velocity of from 0.25 to 4 $kg.kg^{-1}.h^{-1}$ and a rate of catalyst replenishment of from 0.1 to 5 tonnes of catalyst per 100 tonnes of feed.

4. A process according to claim 1, wherein in step (b) hydrocracking is carried out as a two-stage process in the presence of a weakly or moderately acidic catalyst comprising one or more metals having hydrogenation activity on a carrier in the first stage and a moderately or strongly acidic catalyst comprising one or more metals having hydrogenation activity on a carrier in the second stage.

5. A process according to claim 1, wherein in step (b) hydrocracking is carried out as a two-stage process and that the whole reaction product from the first stage is used as the feed for the second stage.

6. A process according to claim 1, wherein in step (b) hydrocracking is carried out at an average temperature of from 250° to 450° C., a hydrogen partial pressure of from 25 to 300 bar, a space velocity of from 0.1 to 10 $kg.l^{-1}.h^{-1}$ and a hydrogen-to-feed ratio of from 200° to 3000 $Nl.kg^{-1}$.

7. A process according to claim 1 wherein in step (d) the catalytic hydrotreatment is carried out as a two-stage process in the presence of a catalyst consisting of more than 80%w silica in the first stage and a catalyst comprising one or more metals having hydrogenation activity on a carrier, which carrier consists of more than 40%w alumina, in the second stage.

8. A process according to claim 1, wherein in step (d) the catalytic hydrotreatment is carried out at an average temperature of from 375° to 475° C., a hydrogen partial pressure of from 25 to 300 bar, a space velocity of from 0.1 to 1.5 $kg.l^{-1}.h^{-1}$ and a hydrogen-to-feed ratio of from 250 to 2500 $Nl.kg^{-1}$.

* * * * *

UNITED STATES PATENT OFFICE

CERTIFICATE OF CORRECTION

Patent No. 4,120,778 Dated October 17, 1978

Inventor(s) Frans Goudriaan et al.

It is certified that error appears in the above-identified patent and that said Letters Patent are hereby corrected as shown below:

The term of this patent subsequent to December 13, 1994 has been disclaimed.

Signed and Sealed this

*Third* Day of *July 1979*

[SEAL]

*Attest:*

*Attesting Officer*

LUTRELLE F. PARKER

*Acting Commissioner of Patents and Trademarks*